US008344875B2

(12) United States Patent
Becker et al.

(10) Patent No.: US 8,344,875 B2
(45) Date of Patent: Jan. 1, 2013

(54) PUMP STAND

(75) Inventors: Erich Becker, Bad Krozingen (DE); Erwin Hauser, Emmendingen (DE)

(73) Assignee: KNF Neuberger GmbH, Freiburg (DE)

( * ) Notice: Subject to any disclaimer, the term of this patent is extended or adjusted under 35 U.S.C. 154(b) by 483 days.

(21) Appl. No.: 12/594,630

(22) PCT Filed: Mar. 14, 2008

(86) PCT No.: PCT/EP2008/002045

§ 371 (c)(1),
(2), (4) Date: Oct. 5, 2009

(87) PCT Pub. No.: WO2008/119452

PCT Pub. Date: Oct. 9, 2008

(65) Prior Publication Data

US 2010/0119379 A1 May 13, 2010

(30) Foreign Application Priority Data

Apr. 3, 2007 (DE) ..... 10 2007 016 385

(51) Int. Cl.
*G08B 1/08* (2006.01)
*A44L 7/00* (2006.01)

(52) U.S. Cl. ..... 340/539.11; 340/636.1; 340/636.2; 15/319; 15/320

(58) Field of Classification Search ..... 340/539.1, 340/539.11, 691.1, 691.6, 636.1, 636.2; 62/78, 62/264; 361/230, 231; 34/92, 605; 700/245; 15/319, 320
See application file for complete search history.

(56) References Cited

U.S. PATENT DOCUMENTS

| | | | | |
|---|---|---|---|---|
| 5,634,778 | A | 6/1997 | Liegel et al. | |
| 6,082,122 | A * | 7/2000 | Madenokouji et al. | 62/77 |
| 7,040,101 | B2 * | 5/2006 | Takeda et al. | 62/78 |
| 7,312,973 | B2 * | 12/2007 | Sekoguchi et al. | 361/231 |
| 7,389,156 | B2 * | 6/2008 | Ziegler et al. | 700/245 |
| 7,620,476 | B2 * | 11/2009 | Morse et al. | 700/245 |
| 7,761,954 | B2 * | 7/2010 | Ziegler et al. | 15/320 |
| 2004/0090315 | A1 | 5/2004 | Mackjust et al. | |
| 2005/0129535 | A1 | 6/2005 | Beyer et al. | |
| 2005/0232781 | A1 | 10/2005 | Herbert et al. | |

FOREIGN PATENT DOCUMENTS

| | | |
|---|---|---|
| DE | 3813590 | 11/1988 |
| DE | 9400955.4 | 4/1994 |
| DE | 20206267 | 8/2003 |
| EP | 1577559 | 9/2005 |
| WO | 2005002076 | 1/2005 |

* cited by examiner

*Primary Examiner* — Van T. Trieu
(74) *Attorney, Agent, or Firm* — Volpe and Koenig, P.C.

(57) ABSTRACT

A vacuum pump stand (1) for generating and regulating the vacuum intended for a rotary vaporizer, including a control device having a control connection to a control unit (4) having at least one control element (3, 6). In the pump stand (1), the control unit (4) is designed as a remote control unit having a wireless control connection to the control device of the pump stand. Laboratory personnel can thus observe the rotary evaporator and the associated pump stand (1) through the divider of a fume cupboard, in order to be able to modify and readjust the process parameters at the remote control panel as needed. Because the remote control unit (4) has a wireless control connection to the control device of the pump stand (1), the fume cupboard no longer needs to be opened, even momentarily. Rather, the pump stand (1) can be operated from a sufficient distance outside the fume cupboard without the laboratory personnel needing to be exposed to special hazards.

7 Claims, 1 Drawing Sheet

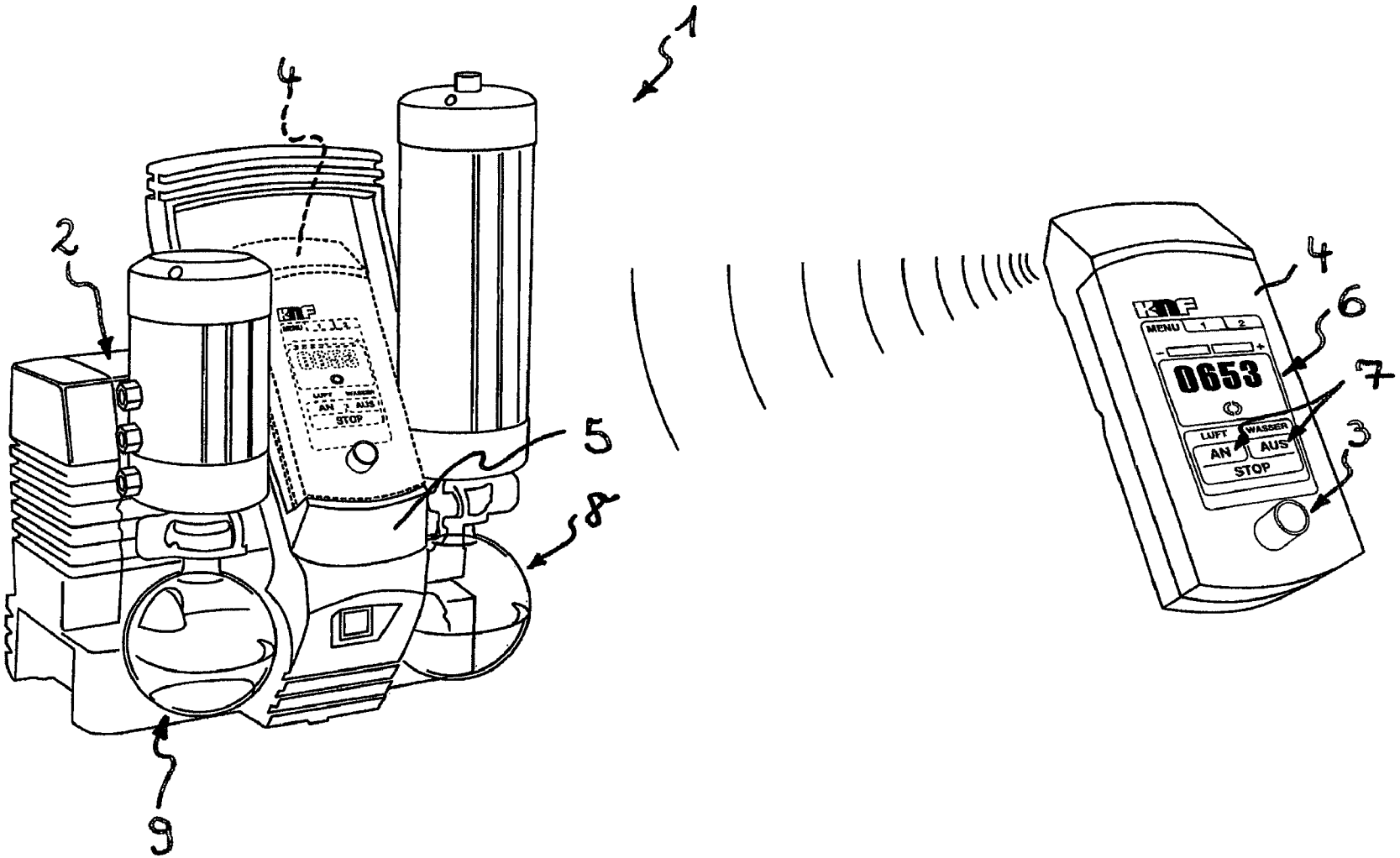
1
2
3
4
5
6
7
8
MENU
0653
LUFT
WASSER
AN
AUS
STOP

PUMP STAND

BACKGROUND

The invention relates to a pump stand for generating and regulating the vacuum intended for a rotary vaporizer, comprising a control device having a control connection to a control unit having at least one control element.

Such vacuum pump stands are required to generate and regulate the vacuum required in rotary evaporators. Here, it is already known to change and readjust the desired processing parameters, for example by changing the rotation of the of the drive engine provided in the pump stand. In such rotary evaporators frequently mixtures of liquids are used having highly volatile components, with their vapors being potentially hazardous. When processing such mixtures of liquids the respective rotary evaporator and the corresponding pump stand must be operated in a fume cupboard, in order to prevent endangering the laboratory personnel. Here, the laboratory personnel must always remain in close proximity in order to observe the functional displays through the divider of the fume cupboard and to monitor the processing parameters, as well as to allow opening the fume cupboard when needed and perhaps activate operating elements provided at the vacuum pump stand, getting exposed to potential health hazards.

This object is attained according to the invention in a pump stand of the type mentioned at the outset, particularly in the control unit being embodied as a remote control unit, being in a wireless control connection to the control device of the pump stand.

From WO 2005/002076 A1 a remote control device is already known, which shall be controllable in a wireless fashion via a remote control unit from a distance and which is designed for the rough handling in the industrial field or in agriculture. In order to allow a secure and definite allocation of a remote control to a device for technical security reasons, and in order to safely avoid any contamination of delicate plug-in contacts even under rough operating conditions it is provided in the device known from WO 2005/002076 A1 that prior to starting operation an allocation mode has to run first, which ensures a definite allocation on the one hand of the device to the corresponding remote control on the other hand. Although the device known from WO 2005/002076 A1 is allegedly provided with a docking station for the remote control, too, at which the remote control can temporarily be fixed, however this fails to change the fact that the above-mentioned device itself can only be controlled by the radio connection, requiring said allocation mode, and not via a wired control connection when the remote control is located in the docking station. The control connection exclusively operating via radio bears the risk, though, that the device must continue operating in an uncontrolled fashion when the batteries are "dead" and that in this situation a controlled connection cannot be reestablished fast enough after the remote control has been returned to the docking station.

From US 2005/0129535 A1 a pump stand with a pump unit is known, which is in a wireless control connection to a control unit. Therefore, the pump unit and the control unit of the above-mentioned pump stand comprise transmitting and receiving devices, allowing an alternating exchange of command and data signals. Here the wireless command and data paths are monitored via a monitoring device, which switches the pump into a safety mode when the command and data paths are interrupted due to malfunction. When this safety mode includes switching the pump to a predetermined pumping operation it bears the risk, though, that this process, among other things also controlled via the pump, requires a pump performance deviating from the one of the predetermined pumping operation in order for example to avoid an overreaction in the process; when in said safety mode the pump known from prior art is set to an off mode, however, any previously achieved processing results may be lost perhaps also depending on the pump.

From EP 1 577 559 A1 a vacuum pump stand is known, in which a vacuum pump is wirelessly control connected to a control unit. In this known vacuum pump stand of prior art, too, the control unit and the pump unit comprise transmitting and receiving devices allowing an alternating exchange of command and data signals. However, here too, there is the risk in this vacuum pump stand of prior art that the pump stand must continue operating in an uncontrolled fashion when the battery in the control unit is "dead" and that in this situation a control connection cannot be reestablished fast enough.

Therefore, the particular object is to provide a pump stand of the type mentioned at the outset, which is characterized in simple handling and largely excludes any risks of health hazards for laboratory personnel.

SUMMARY

The object of the invention is attained in a pump stand of a type mentioned at the outset particularly in that a panel to receive or support the control unit is provided at the pump stand, which also comprises a contact system for the power supply to the charging system for the batteries located in the control unit 4, that the pump stand can be operated either immediately via the control unit located on the panel or may also be wirelessly operated via the remote control unit from a distance, and that the control unit comprises at least one touch-screen embodied as a display for the processing parameters as well as a control element serving to select the control functions and/or to change the processing parameters.

The pump stand according to the invention comprising a control unit embodied as a remote control unit being in a wireless control connection to the control device of the pump stand. This way, the laboratory personnel can observe the rotary evaporator and the corresponding pump stand through the divider of the fume cupboard, in order to change and readjust the processing parameters at the remote control unit, if necessary. Due to the fact that the remote control unit is in a wireless control connection to the control device of the pump stand, here opening the fume cupboard even momentarily is not required. Rather, the pump stand can be operated from a sufficient distance outside the fume cupboard without the laboratory personnel being exposed to particular risks.

Here, the pump stand according to the invention comprises a panel to receive or support the control unit. When the control unit rests upon the panel the pump stand can be directly operated conventionally via the control unit located on the panel. However, when the pumping processes requires a safety distance of the operating personnel the pump stand may also be operated from a distance via the remote control unit wirelessly control connected to the pump stand. Therefore, exclusively the pump stand according to the invention is characterized in that it can be operated optionally with the control unit located on the panel or with the remote control unit being operated wirelessly at a distance. Here, a particular advantage of the pump stand according to the invention is given in that the panel also comprises a contact system for the power supply to the charging system for the batteries located in the control unit. Via this contact system the batteries located in the control unit can always be recharged when the pump stand is operated directly via the control unit located in the console. This way it is ensured that the control unit always has sufficient power available when the pumping process requires a distance between the pump stand, on the one hand, and the remote control unit, on the other hand, and the pump stand shall additionally be controlled wirelessly via the remote control at a distance.

It is possible to provide sufficiently large displays at the pump stand, allowing the present processing parameters to be read and controlled even from outside the fume cupboard. However, the simple handling of the pump stand according to the invention is promoted when the remote control unit comprises at least one display for showing the processing parameters, connected to the pump stand via wireless data transmission. Due to the fact that in the pump stand according to the invention the present processing values can be read as well as changed at the remote control unit, the pump stand according to the invention can also be easily monitored and controlled from outside the fume cupboard at a distance. Here, it is particularly advantageous when an automatic boiling point recognition can be displayed on the remote control unit.

The wireless data transmission and/or control connection may represent an ultrasound or an infrared connection, for example. However, a radio connection is preferred. Due to the fact that such a wireless connection is of a more or less limited action radius, and when said action radius is accidentally exceeded there is the risk that the rotary evaporator operates in an uncontrolled fashion, it is useful for the remote control unit to comprise an optical and/or acoustical warning display triggering an alarm as soon as the remote control unit has left the functional range of the wireless data transmission and/or control connection.

In order to allow a manual operation of the remote control unit in a simple fashion it is beneficial for the remote control unit to comprise at least one control button as a control element, which serves to select the control functions and/or to change the processing parameters. Additionally or alternatively the remote control unit may comprise a touch-screen as the control element, which also serves to select the control functions and/or to change the processing parameters. At said touch-screen the operation can occur by directly tapping the buttons displayed on the display. Here, a preferred embodiment provides for the touch-screen to be simultaneously embodied as the display for showing the processing parameters. It is particularly advantageous for the remote control unit to comprise at least one control button and at least one touch-screen being in an operative connection with each other. Here, the pressure in the rotary evaporator is preferably regulated via the rotation of the vacuum pump provided in the pump stand, which is adjustable at the remote control unit, in order to precisely set the boiling point and thus avoid any foaming of the medium, achieve noise reduction, and optimize the life of the pump stand.

In order to exclude operating errors it is advantageous when particular primary functions of the control device can only be selected when the pump stand is turned off, while important processing parameters may also be changed during operation.

A preferred embodiment according to the invention provides that individual functions of the control device are arranged in a menu structure and that the individual menus may be browsed using at least one control element. In this embodiment the menu can be browsed by operating the control button and/or tapping on the touch-screen.

It is advantageous for an emergency switch to be provided at the pump stand itself and/or at the remote control unit.

A preferred embodiment according to the invention provides for the pump stand to comprise at least one diaphragm pump.

BRIEF DESCRIPTION OF THE DRAWINGS

Further developments according to the invention are discernible from the claims and the drawing. In the following the invention is described in greater detail using a preferred exemplary embodiment.

The single FIGURE is a perspective view of the invention.

DETAILED DESCRIPTION OF THE PREFERRED EMBODIMENTS

The single FIGURE shows a pump stand 1, which is provided for generating and regulating a vacuum intended for a rotary evaporator, not shown in greater detail here. In order to generate a vacuum, the pump stand 1 comprises at least one vacuum pump 2, here embodied as a diaphragm pump, with a drive engine being allocated thereto. In order to change and regulate the desired processing parameters, the rotation of the drive engine provided in the pump stand 1 may be adjustable, for example. Here, the adjustable processing parameters can be regulated at a control device, which is control connected to a control unit 4 comprising at least one control element 3.

It is indicated in the FIGURE that the control unit 4 is embodied as a remote control unit, being in a wireless control connection to the control device of the pump stand 1. This way the laboratory personnel can observe the rotary evaporator as well as the corresponding pump stand through the divider of a laboratory fume cupboard, in order to change and readjust the processing parameters at the remote control unit, if necessary. Due to the fact that the control unit 4 is in a wireless control connection to the control device of the pump stand 1, here not even a momentary opening of the exhaust is required. Rather the pump stand 1 can be controlled from a sufficient distance outside the exhaust without subjecting the laboratory personnel to particular risks.

A panel 5 to receive or support the control unit 4 is provided at the pump stand 1. The perimeter of the control unit 4 in the area of the panel 5, indicated in dot-dash lines, show that the pump stand 1 can be directly operated optionally via the control unit 4 located on the panel 5 or via the remote control unit 4 at a distance. In order to operate the control unit 4 off-line even over an extended period of time a contact system is provided for the power supply to the charging system of the batteries located inside the remote control unit.

The control element provided at the control unit 4 is here embodied as a control button 3, which is determined to select the control function and/or to change the processing parameter. The control unit 4 additionally comprises a touch-screen 6 as a control element, which also serves to select the control functions and/or to change the processing parameters. The operation can occur at this touch-screen 6 by directly tapping onto the buttons 7 shown at the display. Here, the touch-screen 6 is simultaneously embodied as the display to show the processing parameters. The control button 3 and the touch-screen 6 are in an operative connection. Here, the pressure in the rotary evaporator is preferably adjusted at the control unit 4 via the adjustable rotation of the vacuum pump 3 provided in the pump stand, in order to precisely adjust the boiling point and to avoid any foaming of the medium, yield noise reduction, and allow optimization of the life of the pump.

In order to exclude operating errors particular primary functions of the control device can only be selected when the pump stand 1 is turned off, while important processing parameters may also be adjusted during operation. Individual functions of the control device are arranged in a menu structure, with control elements 3, 6 serving to browse the individual menus.

An emergency switch is provided at the pump stand 1 itself. Two separators are integrated in the pump stand 1, with one separator 8 being arranged upstream in reference to the vacuum pump and one separator 9 downstream in reference to the vacuum pump.

The invention claimed is:

1. A pump stand (1), provided for generating and regulating a vacuum intended for a rotary evaporator, comprising a control device in a control connection to a control unit (4) including at least one control element (3, 6), a panel (5) to receive or support the control unit (4) is provided at the pump stand (1), which also comprises a contact system for power supply to a charging system for batteries located in the control unit (4), and the pump stand (1) can be operated either directly by the control unit (4) located on the panel (5) or wirelessly at a distance via the control unit (4) which is configured as a remote control unit (4) that, along with the batteries located therein, can be moved from a first position on the panel (5) to a second, remote location from the panel (5), and the control unit includes at least one touch-screen adapted to display processing parameters and is also configured as the control element allowing a user to at least one of select control functions or change the processing parameters.

2. A pump stand according to claim 1, wherein the remote control unit (4) comprises at least one of an optical or acoustical warning display, triggering an alarm as soon as the remote control unit (4) has at least one of left an operating range of the wireless data transmission or the control connection.

3. A pump stand according to claim 1, wherein the remote control unit (4) comprises at least one control button (3) as the control element, which serves to at least one of select the control functions or to change the processing parameters.

4. A pump stand according to claim 1, wherein particular primary functions of the control device can only be selected when the pump stand (1) is turned off.

5. A pump stand according to claim 1, wherein individual functions of the control device are arranged in a menu structure and that browsing through the individual menus occurs via the at least one control element (3, 6).

6. A pump stand according to claim 1, wherein an emergency switch is provided at least one of the pump stand (1) itself or at the remote control unit.

7. A pump stand according to claim 1, wherein the pump stand (1) comprises at least one diaphragm pump (2).

* * * * *